US008114037B2

(12) United States Patent
Lewis

(10) Patent No.: US 8,114,037 B2
(45) Date of Patent: Feb. 14, 2012

(54) HYDRAULICALLY ACTUATED EXTERNAL PULSATION TREATMENT APPARATUS

(76) Inventor: Michael Paul Lewis, Houston, TX (US)

( * ) Notice: Subject to any disclaimer, the term of this patent is extended or adjusted under 35 U.S.C. 154(b) by 1212 days.

(21) Appl. No.: 11/765,942

(22) Filed: Jun. 20, 2007

(65) Prior Publication Data

US 2008/0319248 A1 Dec. 25, 2008

(51) Int. Cl.
*A61H 31/00* (2006.01)

(52) U.S. Cl. ..... 601/151; 601/143; 601/148

(58) Field of Classification Search ..... 601/41, 601/44, 148, 149, 150, 151, 152, 132.134, 601/136, 143–147; 600/16, 17; 602/13; 128/DIG. 20; 606/201, 202
See application file for complete search history.

(56) References Cited

U.S. PATENT DOCUMENTS 1,868,452 A * 7/1932 Whitney ..... 601/146
1,878,925 A * 9/1932 Whitney ..... 601/146
3,303,841 A 2/1967 Dennis
3,654,919 A 4/1972 Birtwell
3,734,087 A 5/1973 Sauer
3,786,802 A 1/1974 Hagopian
3,835,845 A 9/1974 Maher
3,866,604 A 2/1975 Curless
3,878,839 A 4/1975 Norton
6,620,116 B2 * 9/2003 Lewis ..... 601/41
2004/0073146 A1 * 4/2004 Weintraub et al. ..... 601/134
2006/0074361 A1 * 4/2006 Zicherman ..... 601/144

* cited by examiner

*Primary Examiner* — Quang D Thanh
(74) *Attorney, Agent, or Firm* — Keeling Patents & Trademarks, LLC; Melissa M. Martinez; Heather N. Schmidt

(57) ABSTRACT

There is provided a non-invasive pulsation and counterpulsation medical treatment apparatus for treating reduced cardiac output in heart patients. A flexible cuff is passed over the patient's lower body and/or extremities, and is attached a hydraulic actuator. Through a mechanical linkage, the actuator sequentially tensions and releases the cuff, thereby sequentially compressing and releasing pressure on the patient, and thereby augmenting the patient's blood pressure. The actuator includes a hydraulic cylinder that axially extends and retracts a shaft. A curved plate on the apparatus supports the patient's body or extremity in a fixed position during the treatment. A pressure sensor in the cuff transmits pressure data to an operator or electronic processor. Based on physiological data continuously obtained from the patient, various treatment parameters may be changed during the patient's treatment by an attending clinician or by a computer processor controlling the treatment.

24 Claims, 10 Drawing Sheets

HYDRAULICALLY ACTUATED EXTERNAL PULSATION TREATMENT APPARATUS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention related generally to medical treatment devices, and, more particularly, to a counterpulsation treatment apparatus for treating reduced cardiac output in patients, specifically, for treating occlusions in coronary arteries.

2. Description of the Related Art

External counterpulsation has developed as a means of treating reduced cardiac output and circulatory disorder stemming from disease. Counterpulsation treatment involves the application of pressure, usually from distal to proximal portions of a patient's extremities, where such application is synchronized with heart rhythms. The treatment augments blood pressure, typically increasing pressure during the diastolic phase of the heart, as such treatment is known to relieve and treat medical conditions associated with reduced cardiac output. Clarence Dennis described an early hydraulic external counterpulsation device and method of its use in U.S. Pat. No. 3,303,841 (Feb. 14, 1967). Dr. Cohen, in American Cardiovascular Journal (30(10) 656-661, 1973) described another device for counterpulsation that made use of balloons which would sequentially inflate and deflate around the limbs of a patient to augment blood pressure. Similar devices using balloons have been described in Chinese patents CN 85200905 (U.S. Pat. No. 4,753,226); Chinese patents CN 88203328, and CN 1057189A.

A series of Zheng patents, including U.S. Pat. No. 4,753,226 (Jun. 28, 1988), U.S. Pat. No. 5,554,103 (Sep. 10, 1996), and U.S. Pat. No. 5,997,540 (Dec. 7, 1999) disclose counterpulsation devices employing sequential inflation of balloon cuffs around the extremities, wherein the cuffs are inflated by a fluid. All three Zheng patents disclose an external counterpulsation device where a series of air bladders are positioned within a rigid or semi-rigid cuff around the legs. The bladders are sequentially inflated and deflated with fluid, such that blood pressure is augmented in the patient. The Zheng '103 and Zheng '540 patents provide for cooled fluid and for monitoring of blood pressure and blood oxygen saturation; however, both retain a similar mechanism dependent on compression of fluid such as air. The Zheng '540 patent modifies the shape of the air bladder and cuffs, but retains a similar mechanism requiring rapid fluid distribution, influx and efflux through balloons in the cuffs.

U.S. Pat. No. 3,734,087 to Sauer et al., U.S. Pat. No. 3,786,802 to Hagopian, et al. and U.S. Pat. No. 3,835,845 to Maher, all disclose a system that utilizes a hydraulically actuated rod to move a platen from a resting position to a position placing pressure on a liquid filled bladder. Liquid is either removed or added to the bladder over several cycles in order to regulate the pressure against the patient's legs. This procedure of regulating the pressure output of the invention is inefficient due to the time and imprecision involved in making the necessary adjustments.

Bladders are also utilized to regulate the pressure exerted on the subject's extremities in U.S. Pat. No. 3,866,604 to Curless, et al. and U.S. Pat. No. 3,654,919 to Birtwell. As stated above, this procedure is ineffective and imprecise. Britwell further teaches the use of a hydraulically driven piston to switch between a suction zone and a hydraulic zone. In a first position, liquid is released into the bladder system affixed circumferentially around the subject's legs. In an opposite second position, the liquid is removed. This invention does not allow for quick and precise adjustments of the resulting pressure and the piston is not adjustable to a plurality of positions in order to more finely tune the pressure output.

There are several deficiencies with prior pulsation treatment devices. First, the required circuitous movement of fluid through the apparatus causes a delayed response to changes in pressure settings for the balloons or air bladders. Second, there is also a consequent inability to manipulate action of the cuffs with a high degree of precision. Third, many of the prior art devices require a relatively heavy and noisy compressor. Fourth, the prior devices lack portability due to their large size and weight, and their reliance on a compressor. There are also deficiencies in some of these devices with regard to patients being bounced up and down while undergoing pulsation treatment.

Electromechanical solenoids were typically used to actuate the prior art designs in part due to their relative ease of installment as opposed to pneumatic or hydraulic actuators. Typically solenoids are also utilized for their quick operation. U.S. patent application Ser. No. 11/420,133 to Michael Lewis, the inventor herein, utilizes an electromechanical actuator comprising a solenoid that will operate on a 120-volt source of electric power. While this particular type of actuator is effective, a hydraulic actuator will prove to be more powerful and less prone to the typical wear seen in electrical components.

Hydraulic actuators are ideal for applications requiring precise control and smooth motion. Utilizing hydraulic actuators will allow for a greater plurality of adjustments in the tension of the cuff system due to the ease of regulating the pressure exerted on the hydraulic actuator itself. These types of minute adjustments are not as easily obtainable when utilizing an electromechanical actuator. The solenoids typically used in electromechanical actuators are better equipped to fluctuate from a fully open position to a fully closed position. While it may be possible to generally operate between these two extremes, the resultant operation will not be as fine tuned as when a hydraulic actuator is utilized.

Hydraulic actuators require less treatment table space because the actuators themselves are relatively smaller and less bulky than their electromechanical counterparts allowing for a relatively smaller frame. Hydraulic actuators produce less heat as well preventing premature shut downs due to overheating, which allows for extended use. Further, the hydraulic system's accumulator stores energy while the actuator is stationary which is a great advantage when the actuators are used intermittently, as in the present invention. A further benefit is the ability for several hydraulic actuators to share a single pump. This ability to operate several actuator from a single pump unit can result in lower costs per treatment as compared to electromechanical systems. Finally, the pressure generated from a hydraulic system can be maintained at a constant level without the need for signification additional energy.

A need therefore exists for a pulsation treatment apparatus that provides a rapid response to changes in applied pressure settings, and that permits control of cuff pressure with an even higher degree of precision than with an electromechanical actuator. Preferably, such a treatment apparatus will not require fluid filled balloons or air bladders and will not subject the patient to undesirable or unnecessary movement.

BRIEF SUMMARY OF THE INVENTION

The present invention addresses the aforementioned needs. According to one embodiment of the invention, an apparatus for use in counterpulsation treatment of a patient, wherein pressure is applied to the patient's blood vessels to stimulate blood flow, comprises a cuff to be received on a patient's extremity. The cuff has first and second ends. First and second hydraulic actuators are associated with the cuff and controllably operable to a plurality of positions within a range of positions. The range of positions ranges from an original position to a maximum constricted position. The actuators are disposed on opposite sides of the patient. The cuff applies maximum pressure to the patient's blood vessels to constrict the blood vessels in the maximum constricted position of the plurality of positions of the actuator. The cuff applies no pressure to the patient's blood vessels in the original position of the plurality of positions of the actuator. The actuator is controllably operable from the relaxed position to any of the positions within the range of positions on activation.

This invention is a hydraulically actuated pulsation apparatus for use in external pulsation, including counterpulsation or simultaneous pulsation, treatment of reduced cardiac output, congestive heart failure, angina pectoris, heart disease and other circulatory disorders. Counterpulsation has traditionally involved the application of sequential pressures on the lower legs, upper legs and hip areas through pneumatic cuffs placed on those regions. Application of pressure to the extremities has been timed to correlate with a patient's physiological rhythms, such as diastolic and systolic phases of the heart. This application of force by the cuff causes a retrograde wave back up the arteries toward the heart, whereby blood pressure is increased during the diastolic phase of the heart. The sequence of compressions could be reversed to force blood toward the feet. This enhanced diastolic pressure is recognized as beneficial for treatment of medical conditions relating to blood circulation. The present invention utilizes a hydraulically controlled flexible cuff that on activation compresses and applies pressure to a patient's body. Rather than pneumatic or inflatable devices, the present invention uses the cuff to constrict a portion of the patient's body, typically the abdomen and/or the upper and/or lower legs. The cuff is designed to partially encircle an extremity such as a leg, arm, or midsection of a patient's body. Hydraulic means for operation of the cuff is preferably one or more linear hydraulic cylinders mounted on a frame and connected to the cuff through a suitable linkage. Positive pressure from the cuff forces blood from the extremity toward the patient's heart during diastole. It is this augmentation of blood pressure during diastole that provides curative benefit from counterpulsation treatment. Typically, the cuff will release immediately prior to the systolic phase of the patient's heart.

Because the clinician may adjust the sequence in which the actuators are activated, blood can be forced away from the heart to a foot or hand. This is beneficial when treating a diabetic patient with poor blood circulation to these extremities.

It is therefore an object of the present invention to provide a pulsation, including counterpulsation or simultaneous pulsation, treatment apparatus that operates by hydraulic rather than by pneumatic or electromechanical actuation means, and which can be precisely controlled by the operator or automated treatment program. It is a further object of the invention that the treatment apparatus transmit data regarding local pressure applied to the patient. It is a further object of the invention that the pressure applied to the patient by the apparatus be completely adjustable, such that the apparatus may apply fixed pressure, less than its maximum pressure, at times during operation. Other objects of the invention are apparent from the specification and claims as set forth below.

BRIEF DESCRIPTION OF THE DRAWINGS

For a more complete understanding of the present invention and the advantages thereof, reference is now made to the following Detailed Description of Example Embodiments of the Invention, taken in conjunction with the accompanying drawings, in which.

DETAILED DESCRIPTION OF EXAMPLE EMBODIMENTS OF THE INVENTION

Figure 1:
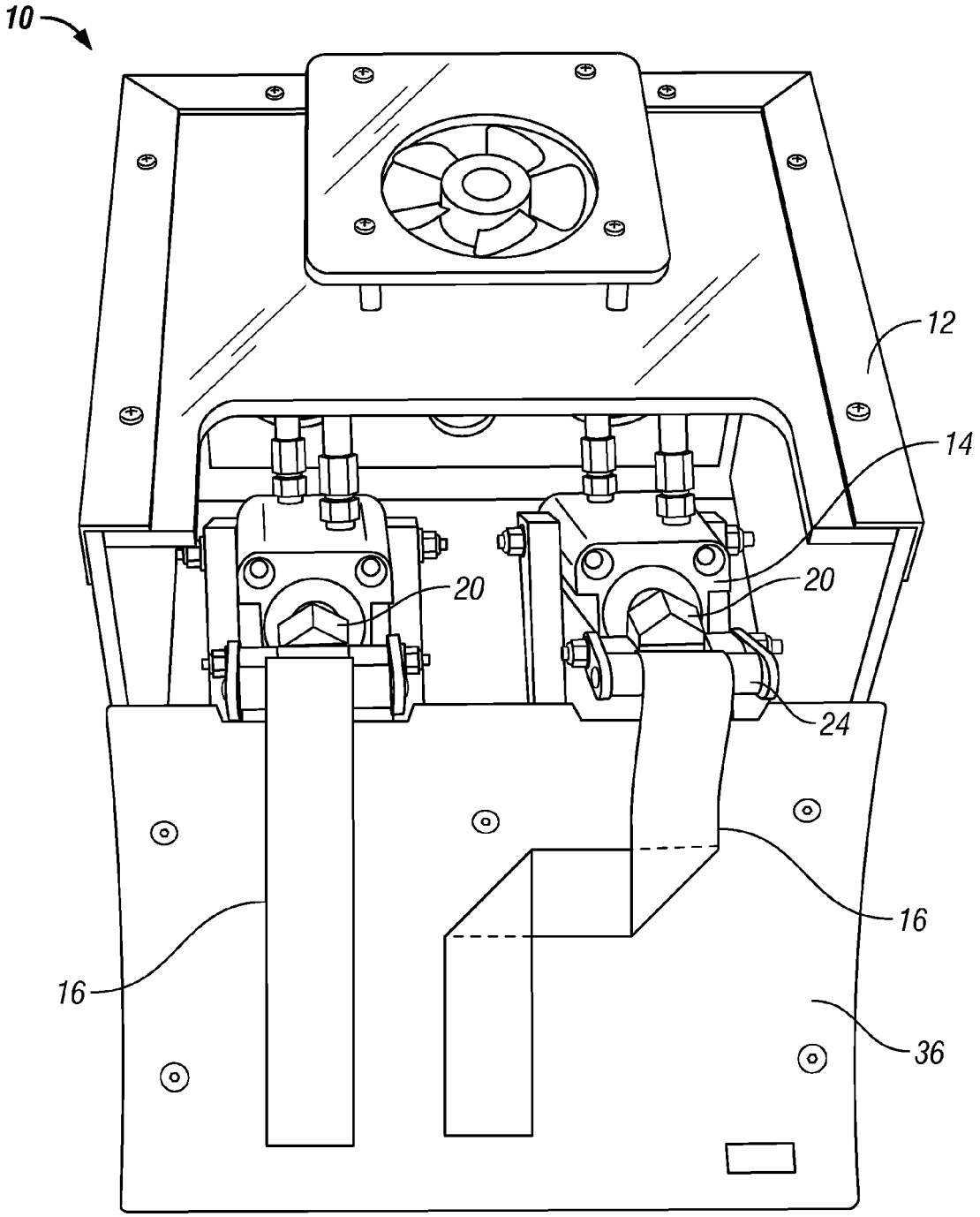
FIG. 1 is a top and front perspective view of a pulsation actuator unit of the present invention for use on a patient's leg with the actuators shown in their retracted positions.

The invention and its advantages are best understood by referring to the drawings, like numerals being used for like and corresponding parts of the various drawings. In FIG. 1, there is shown in perspective view an actuator unit, generally designated 10, used in the treatment apparatus of the invention. Actuator unit 10 can be used for pulsation and counterpulsation treatment of a patient's extremities and hip area. Actuator unit 10 includes a frame 12, a pair of actuators 14, a plate 36, among other components described hereinbelow.

Figure 2:
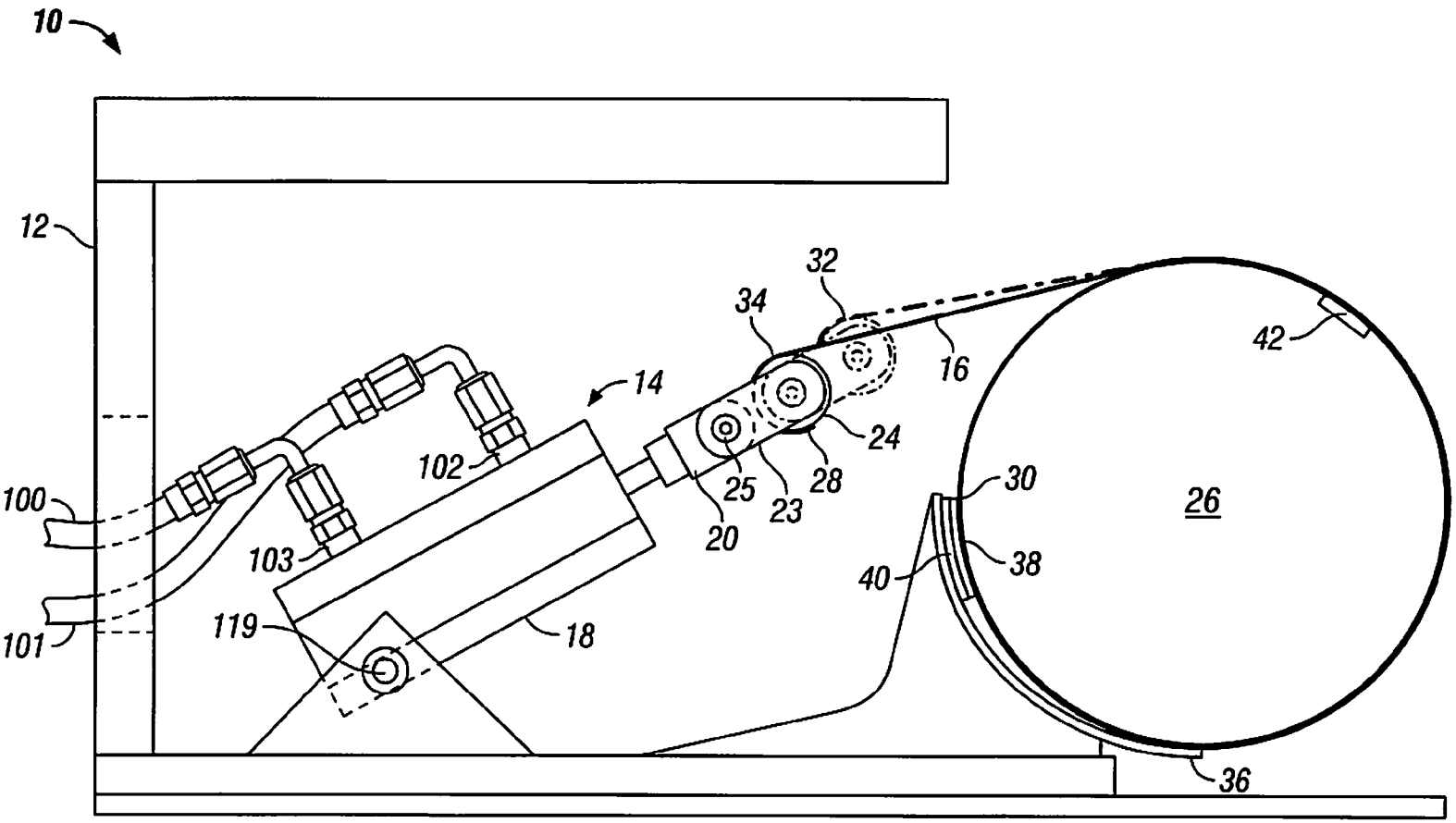
FIG. 2 is a side elevation view of the actuator unit of FIG. 1, as applied to a patient's leg.

FIG. 2 illustrates the use of actuator unit 10 for treating a patient's upper or lower leg 26 or other body member. In the illustrated embodiment, actuator 14 is hydraulic, and includes hydraulic cylinder 18, shaft 20, extensions 23, and roller 24. Hydraulic cylinder 18 is mounted within frame 12. Hydraulic actuators 14 are pivotally connected at their lower end to frame 12 by connector 119. Shaft 20 contains upper and lower ends. Shaft 20 is connected to and driven axially and linearly by hydraulic cylinder 18. Roller 24 is rotatably connected to the upper end of hydraulic cylinder 18 through a linkage 23, 25 made up of pin 25 connected to the upper end of shaft 20 and lower end of extension 23. Roller 24 is rotatably connected between the upper ends of extensions 23. The first end 28 of cuff 16 is fixed to roller 24.

Actuator 14 is hydraulically driven, and is controllably operable to a plurality of positions within a predetermined range of positions. Actuator 14 positions range from an original position to a maximum constricted position. Shaft 20 is linearly driven to a plurality of positions within a range of positions, the range of positions of shaft 20 corresponds to the range of positions of actuator 14. The original position of actuator 14 corresponds to original position 32 of roller 24, and maximum constricted position of actuator 14 corresponds to maximum constricted position 34 of roller 24.

Cuff 16 is sized to partially encircle the patient's leg 26 peripherally. First end 28 of cuff 16 is removably attached to roller 24 on shaft 20. Second end 30 of cuff 16 is removably attached to curved plate 36 of actuator unit 10 by a hook and loop fastener system 38, 40. The hook and loop fastener system has a first fastener component 38 attached to the second end 30 of cuff 16; and a second fastener component 40 attached to plate 36, as best seen in FIG. 2. Plate 36 is curved to conform generally to the patient's leg. In the embodiment illustrated in FIGS. 2-4, plate 36 is generally quarter-cylinder shaped.

In the maximum constricted position of the plurality of positions of actuator 14, cuff 16 applies a predetermined maximum pressure to the patient's leg and blood vessels therein to constrict the blood vessels. In the original position of the plurality of positions of actuator 14, cuff 16 applies zero pressure to the patient's blood vessels so as to not constrict them at all. Actuator 14 is controllably operable from the original position to any of the positions within the range of its positions on hydraulic activation.

In the embodiment of the invention herein illustrated, cuff 16 is rectangular in shape when flat, similar to a wide strap. In alternative embodiments of the invention (not illustrated), cuff 16 is slightly trapezoidal or conical in shape when flat so as to better accommodate increasing or decreasing thicknesses of the patient's leg or other extremity. Cuff 16 is essentially like cuff 58 illustrated in FIGS. 5-7 and described below, except that cuff 16 does not include a thickened portion 56 at its center. A pressure relief valve (not illustrated) is attached to the bladder in cuff 16.

Referring to FIG. 2, pressure sensor 42 is embedded in or attached to the surface of cuff 16. In one embodiment of the invention, pressure sensor 42 provides data to an external control unit (not illustrated) for manual or automatic adjustment of the pressure applied to the patient by cuff 16. Pressure sensor 42 detects the air pressure in cuff 16 which correlates to the degree of compression accomplished by cuff 16, and by the respective actuator 14 during operation. Pressure sensor 42 provides electronic feedback data to the operator or the computer. This data is then processed during treatment for possible adjustment of actuator 14 and cuff 16 operation.

Figure 3:
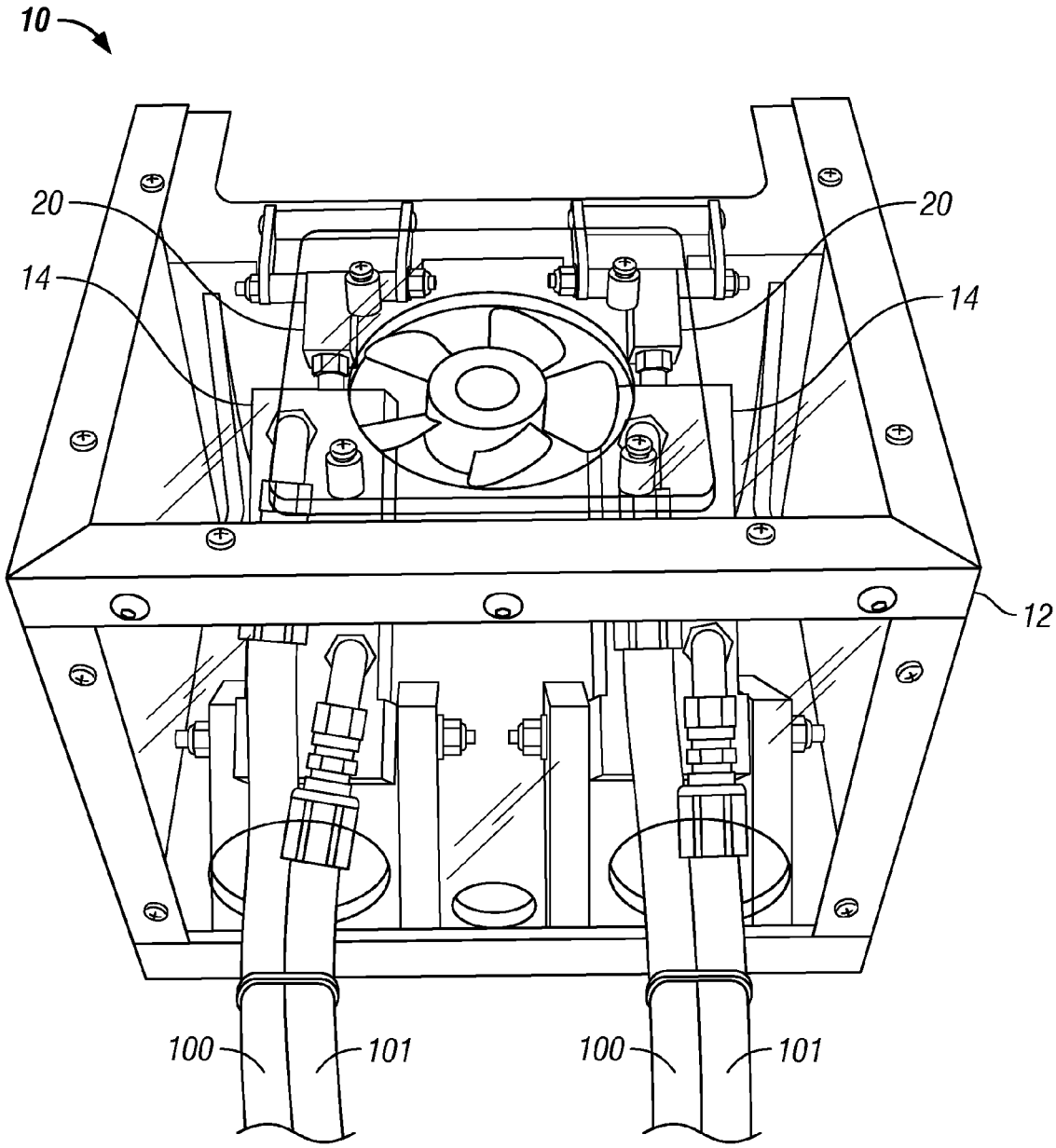
FIG. 3 is a top and rear perspective view of the actuator unit of FIG. 1.

In their original positions 32, rollers 24 of actuators 14 are extended toward the patient's leg 26. In this position, cuff 16 applies no pressure on the patient's blood vessels. In their maximum constricted positions 34, rollers 24 are retracted back toward hydraulic cylinders 18 and away from the patient's leg 26. FIG. 3 is a top and rear elevation view of actuator unit 10.

Figure 4:
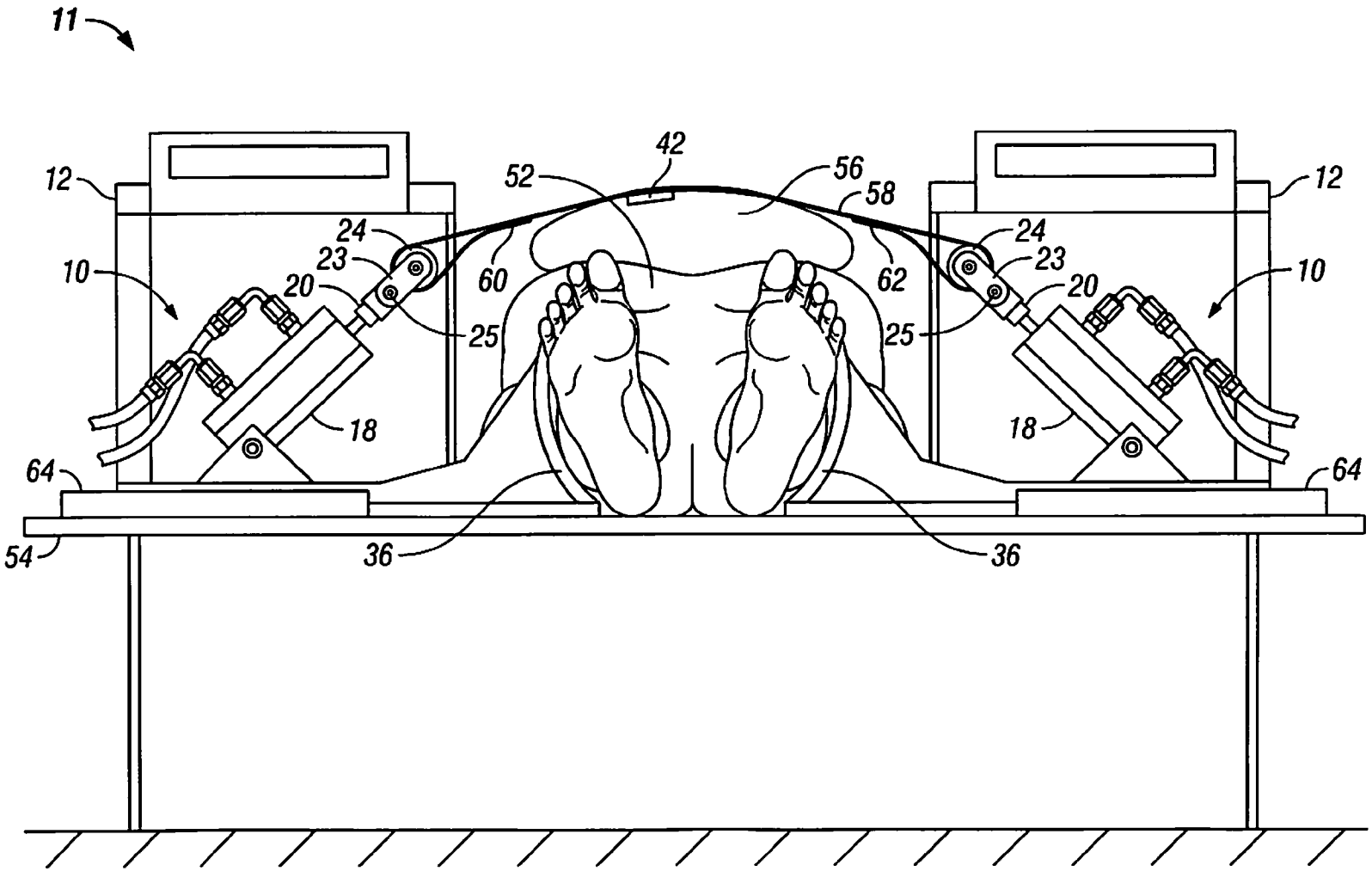
FIG. 4 is a side elevation view of the entire treatment apparatus of the invention, as applied to a patient's hip area.

Referring next to FIG. 4, there is shown a side elevation view of the actuator unit of FIG. 1 as applied to a patient's hip area, according to a second example embodiment of the invention. In this embodiment, the axes of actuators 14 and shafts 20 are pivoted at connector 119 approximately 45 degrees from horizontal to accommodate the larger hip area. However, in alternative embodiments, actuators 14 are tilted at other angles as best suited to the specific application of the invention.

FIG. 4 illustrates the use of treatment apparatus 11 of the present invention for providing a patient's hip area with pulsation treatment, according to an example embodiment of the invention. In the illustrated embodiment, the patient 52 lies on his back on a treatment table 54. Treatment apparatus 50 includes at least two actuator units 10 disposed on opposite sides of the patient near the patient's hips. The actuator units 10 face the patient 52 and each other. Cuff 58 includes a thickened portion 56 that is placed over the patient's lower abdomen.

The opposite ends 60 and 62 of cuff 58 correspond to the first and second ends of cuff 58. The linkages are made up of pins 25 connected to the upper ends of shaft 20, and extensions 23 rotatably connected at their lower ends to pins 25. Rollers 24 are rotatably connected between the upper ends of extensions 23. The ends 60 and 62 of cuff 58 pass around rollers 24 of actuator units 10 and are fastened to cuff 58 by hook and loop fasteners attached to cuff 58, or by other suitable fasteners. Cuff 58 thus applies pressure to the patient through thickened portion 56.

Actuator frames 12 are slidably mounted on treatment table 54 for sliding movement toward and away from the patient 52. The lower portions of actuator frames 12 slide laterally within channel guides 64. Guides 64 also restrain treatment actuator units 10 from vertical movement with respect to table 54 when cuff 58 is tensioned by actuators 14. In an alternative embodiment (not illustrated), only one of actuator frames 12 is slidably mounted, the other actuator frame being fixed in place on treatment table 54. In other alternative embodiments (not illustrated), actuators 14 are restrained from vertical movement by being affixed in other ways to treatment table 54, or by being affixed to one another by a rigid or flexible connecting member (not illustrated) passing under the patient.

Figure 5:
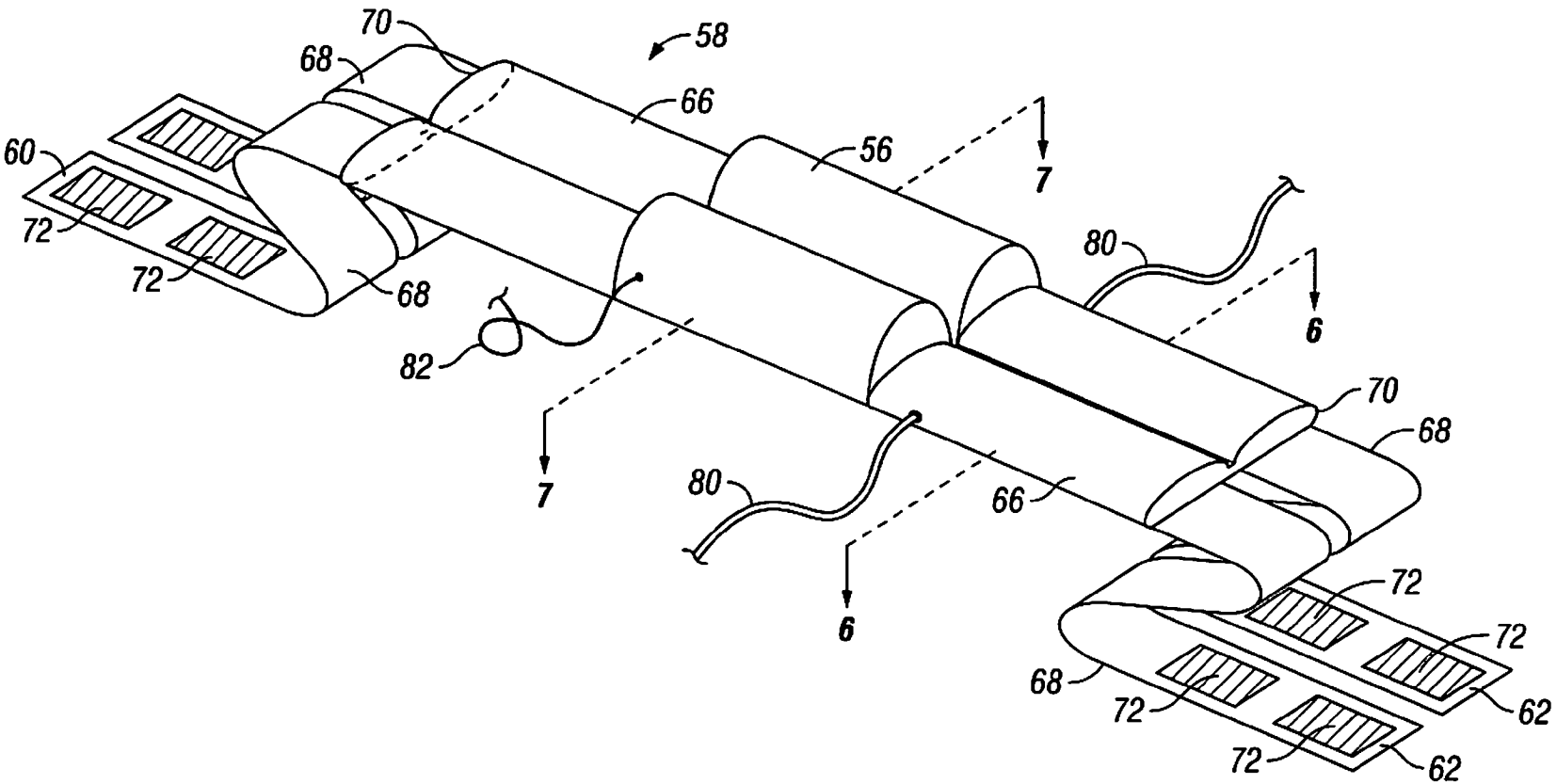
FIG. 5 is a perspective view of a cuff for the actuator unit of FIG. 1.

Referring next to FIG. 5, cuff 58 is made up of two side portions 66 connected by thickened portion 56 at the center of cuff 58. A pair of straps 68 are attached to each outer end 70 of side portions 66 of cuff 58. Hook and loop fasteners 72 are attached near the outer ends of straps 68 for attaching straps 68 to rollers 24 of actuators 14.

Figure 6:
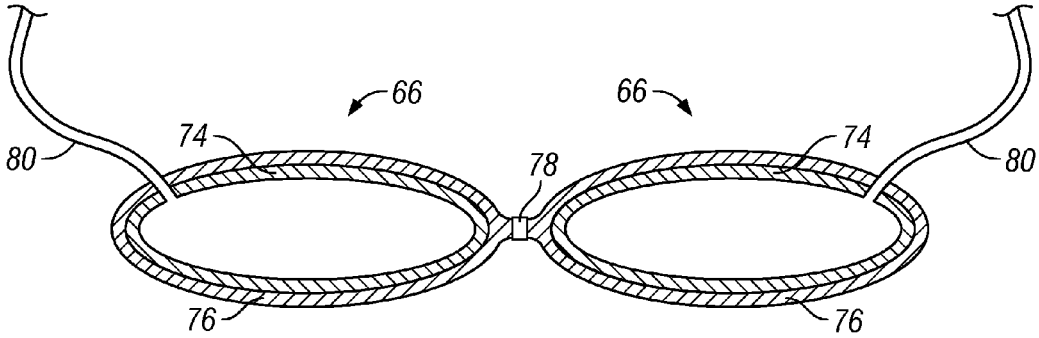
FIG. 6 is a cross-sectional view of the cuff of FIG. 5, taken at section 6-6 in FIG. 5.

Referring to FIG. 6, side portions 66 of cuff 58 are made up of two inflatable rubber bladders 74. Bladders 74 extend the lengths of side portions 66 and are enclosed by a fabric cover 76. In one embodiment of the invention, fabric cover 76 comprises nylon, as sold by Dupont Corporation under the tradename Cordura. Cover 76 is stitched along its center seam 78. As seen in FIGS. 5 and 6, each bladder 74 is inflated with air and deflated through a flexible air hose 80. Air hoses 80 supply air to bladders 74 from a hand pump (not illustrated).

Figure 7:
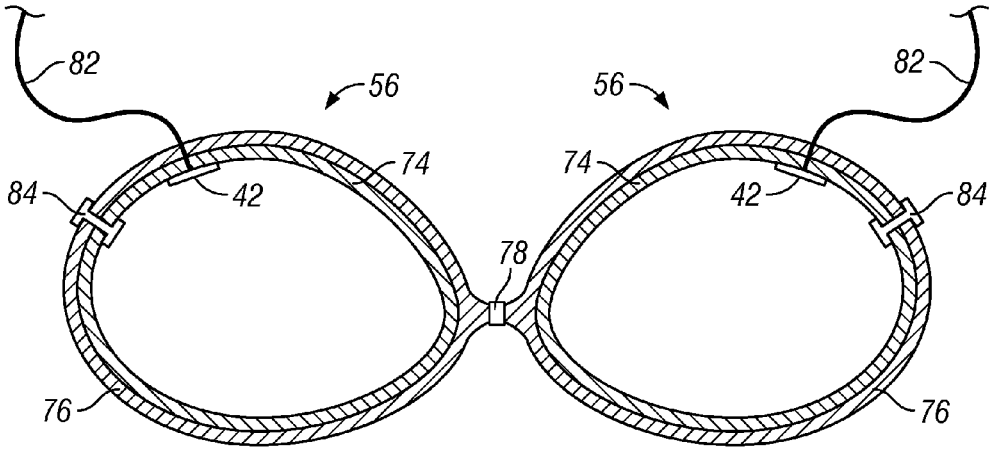
FIG. 7 is a cross-sectional view of the cuff of FIG. 5, taken at section 7-7 in FIG. 5.

Referring to FIG. 7, thickened portion 56 of cuff 58 is also made up of inflatable rubber bladders 74 enclosed by fabric cover 76. However, bladders 74 are much thicker in thickened portion 56 than they are in side portions 66, thereby providing a cushioning effect to the patient when inflated with air. The portions of bladders 74 within thickened portion 56 are in fluid communication with the portions of bladders 74 in side portions 66 of cuff 58. Therefore, inflation of side portions 66 through air hoses 80 also inflates thickened portion 56. Air pressure sensors 42 are installed on the interior of bladders 74 in thickened portion 56. Pressure signal wires 82 lead from pressure sensors 42 to the signal processor (not shown) for actuator unit 10. Pressure relief valves 84 are also installed on the interior of bladders 74 in thickened portion 56. Pressure relief valves 84 prevent damaging overcompression of the patient by cuff 58.

Cuff 16 for leg pulsation treatment is like cuff 58 described above, except that cuff 16 does not have a thickened center portion 56. The inflatable bladders of cuff 16 are therefore uniform in thickness over their entire lengths.

Figure 9:
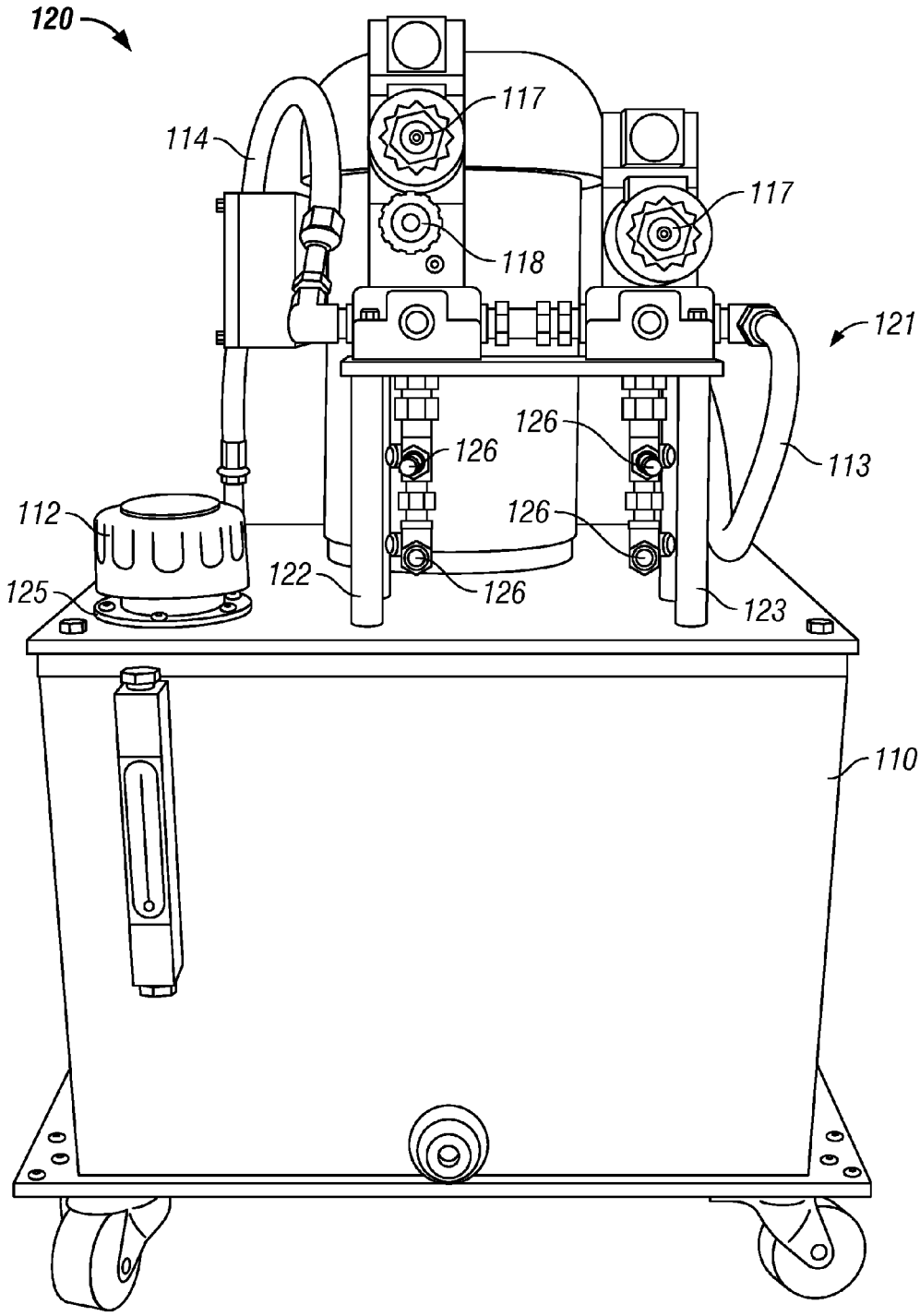
FIG. 9 is a front and top perspective view of the power unit of the present invention.
Figure 10:
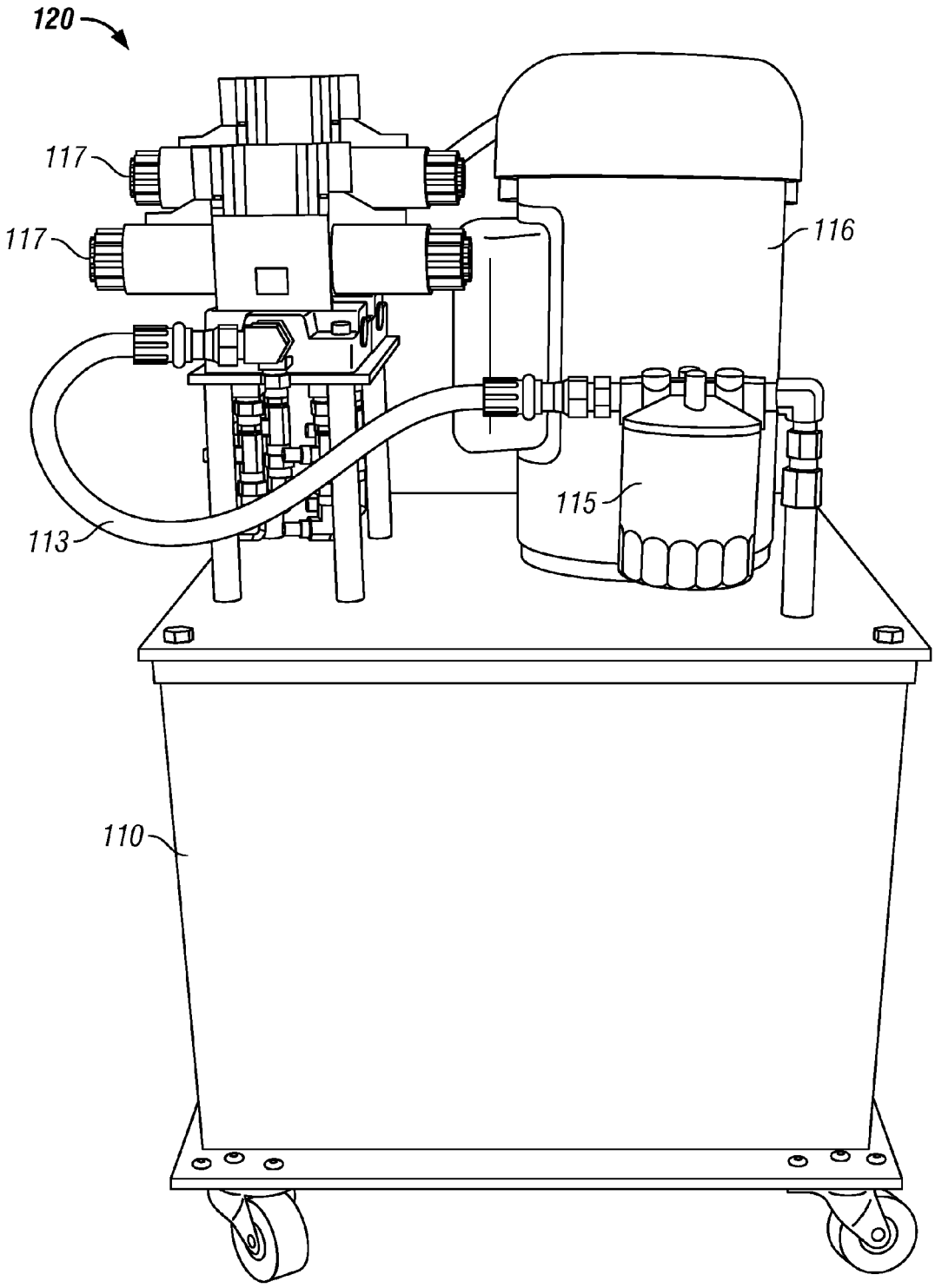
FIG. 10 is a side perspective view of the power unit of FIG. 9.
Figure 11:
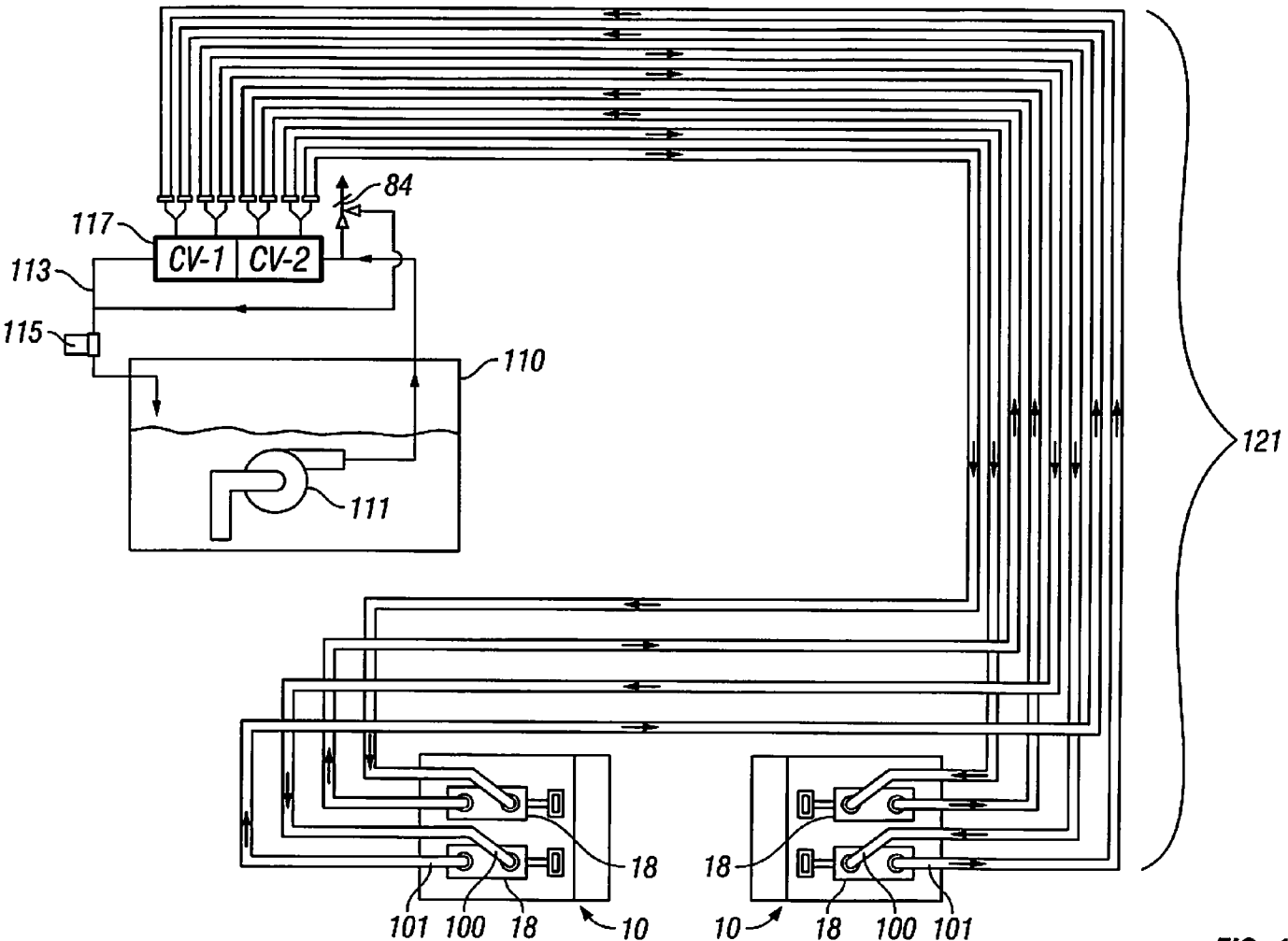
FIG. 11 is a fluid flow schematic for the treatment apparatus of the invention.

Referring to FIGS. 9-11, the power unit, generally designated 120, controls the hydraulic actuators 14 within actuator unit 10. In the depicted exemplary embodiment, power unit 120 provides the hydraulic fluid for two actuator units 10. Motor 116 provides the necessary power to operate the hydraulic system. Motor 116 is functionally attached to power unit 120. Reservoir 110 contains a submersible hydraulic pump (not illustrated) that is attached to the interior of reservoir 110. Reservoir 110 is replenished with hydraulic fluid through reservoir access port 125. In an exemplary embodiment, access port 112 contains a threaded protrusion (not illustrated) extending outwardly from reservoir 110. This protrusion is threadedly attached to cap 112 in order to close reservoir access port 125.

Directional valves 117 are connected to power unit 120 at connection junction 121. Pressure relief valve 118 is connected intermediate at least one directional valve 117 and connection junction 121. Relief Valve 118 relieves the pressure in the system once the pressure has surpassed a predetermined limit and will reclose once normal operating pressure has been achieved.

The submersible hydraulic pump supplies hydraulic fluid via supply line 114. Supply line 114 is removably connected to first side 122 of connection junction 121. Return line 113 is removably connected to second side 123 of connection junction 121. Return line 113 returns the hydraulic fluid to reservoir 110 by first directing the fluid through filter 115 in order to remove impurities and keep the fluid in reservoir 110 uncontaminated.

In an exemplary embodiment, connection junction 121 is comprised of eight connection terminals 126. Connection terminals 126 removably connect to their respective supply hoses 100 or return hoses 101, depicted in FIGS. 2, 3, and 11. In an exemplary embodiment, supply hoses 100 and return hoses 101 are flexible and all remaining lines are rigid. In a second exemplary embodiment, supply hoses 100, return hoses 101, supply line 114 and return line 113 are all flexible.

As shown in FIG. 2, supply hose 100 is removably connected to actuator 14 at connection terminal 102. Return hose 101 is removably connected to actuator 14 at connection terminal 103.

Referring to the fluid flow schematic in FIG. 11, submersible hydraulic pump 111 pumps hydraulic fluid to directional or 4-way control valves 117, which control the flow of the hydraulic fluid. Pressurized hydraulic fluid is transmitted to actuators 14 through connection junction 121 and supply hoses 100. The hydraulic fluid is returned from actuators 14 through return hoses 101 and connection junction 121. Return line 113 then directs the hydraulic fluid to filter 115 and the filtered fluid is returned to reservoir 110.

In one embodiment, directional valves 117 are solenoid operated directional valves, as manufactured by Northman Fluid Power Inc., as part number SWH-G02-C3-D24. Pressure relief valve 118 is a modular relief valve, as manufactured by Northman Fluid Power, Inc., as part number MRF-02-P-2. Motor 116 is a one and a half horsepowered electric motor, as manufactured by WEG Electric Motors Corporation, as part number 00158ES1BF56CFL.

The invention includes a method of treating a patient's medical condition using pulsation or counter pulsation wherein pressure is applied to and released from a patient's blood vessels to stimulate blood flow correlated with the patient's physiological data based on data received from at least one physiological measuring device. This method includes (1) applying a cuff to a patient. The cuff has at least one hydraulic actuator connected to it. The actuator is controllably operable to a plurality of positions within a range of positions. The actuator positions range from an original position to a maximum constricted position. The cuff applies maximum positive pressure to the patient's blood vessels to constrict the blood vessels in the maximum constricted position of the plurality of positions of the actuator. The cuff applies no pressure to the patient's blood vessels in the original position of the plurality of positions of the actuator. The hydraulic actuator unit is controllably operable from the original position to any of the positions within the range of positions on activation. The hydraulic actuator unit is operable at variable frequencies. At least one such variable frequency is responsive to at least one type of data from a physiological measuring device. In one embodiment of this method, the cuff has a pressure sensor for communicating with an external processor.

The method includes the further steps of (2) applying sensors to the patient to detect physiological data; (3) detecting physiological data from the patient through use of the sensors; (4) transmitting the physiological data electronically from the sensors to a processor; (5) electronically processing the physiological data to determine when the patient's heart is in a diastolic or a systolic phase; (6) electronically timing the activation of each hydraulic cylinder 18 to correlate with the phases of the patient's heart; and (7) modifying the timing of the activation of the plurality of hydraulic cylinders according to changes in the physiological data affected by the activation.

In an exemplary application of the device and method, a patient who is to be given pulsation treatment lies down on his back on treatment table 54. He places his legs against curved plates 36 of actuator units 10. Cuffs 16 of actuator units 10 are placed around his upper and lower legs, as seen in FIG. 2. Actuator units 10 are moved together to treat the hip area so that their plates 36 are brought into contact with the patient's hips, as seen in FIG. 4. Cuff 58 is then placed over the patient's lower abdomen, and ends 60 and 62 of cuff 58 are secured to rollers 24 of actuator units 10 so that the slack is removed from cuff 58. Hand pumps are then operated to inflate bladders 74 in all the cuffs. Inflation of bladders 74 applies a gentle pressure to the patient's legs and lower abdomen.

In operation of actuator units 10, when actuators 14 are hydraulically engaged, actuator shafts 20 retract back toward the actuators 14, thereby tensioning cuffs 16 or 58, thus applying pressure to the patient according to predetermined medical treatment parameters. The pressure applied to the patient varies in direct proportion with the force produced by actuators 14, which in turn varies with the hydraulic pressure supplied to actuators 14. The pressure applied to the patient by cuffs 16 or 58 is reduced by disengaging the hydraulic pressure used to pull the shafts 20 toward actuators 14 which allows the patients body to exert the necessary resistance to extend shafts 20 away from actuator 14, relaxing cuffs 16 or 58. In an alternative embodiment, hydraulic pressure is exerted in order to extend shafts 20 to original position 32.

The treatment parameters are correlated with the patient's physiological data, such as diastolic and systolic phases of the heart, to augment blood pressure as necessary. The pressure strength, pressure and relaxation duration, and delay between compressions can be varied separately for each cuff and individual actuator used in a treatment session. The actuators can apply pressure to the patient in many combinations of sequence, amounts of pressure, and duration. The preferable manner is where graded pressure is applied sequentially. Each actuator and respective cuff may also release pressure at variable sequences and by varying degrees. The actuators can relax the cuffs in various manners. In an exemplary application, the cuffs may be relaxed all at once.

Graded pressure means that each actuator is set to apply a specific, but not necessarily identical, amount of pressure to the patient. For example, the actuators for a patient's calves may be set to apply pressure at a greater strength than the actuators for the patient's thighs. Actuators are preferably adjusted so that pressure will increase or decrease from distal to proximal direction on a patient. Pressure on a patient can be applied by one actuator at a time, in any sequence, and at any pressure within the treatment parameters.

An individual actuator may be removed from a sequence of activations, or can be set independently so that one cuff applies pressure more frequently per period of time than will another cuff. Each individual actuator will preferably operate in sequence, whether or not there are gradations in pressure from actuator to actuator.

Graded sequential pressure involves variations in constriction force or pressure from actuator to actuator, and where actuators operate in sequence. For example, actuators for a patient's calves may be set to apply greater pressure than actuators for the patient's hips. In addition to graded pressure, the actuators are generally set to activate in sequence starting from the patient's calves and moving upward to the patient's hip.

The cuffs apply pressure preferably in sequence on a patient from a distal to proximal direction generally with increments in the range of 35.0 to 50.0 milliseconds between initial activation of separate sequential cuffs. All cuffs preferably operate within a compression strength range of zero to 7.0 pounds of pressure per square inch.

In various embodiments of the invention, the length and diameter of curved plate 36 differs to accommodate different body shapes and sizes. For instance, curved plate 36 may be sized to accept a calf, thigh, forearm, or upper arm of an infant, child, or adult patient.

While more than one cuff can be operated simultaneously, each of the cuff actuators can be operated separately with different or identical compression sequences, strengths, and delays. For instance, with the present invention, it would be possible to cause a particular cuff to constrict more frequently in a set period of time than the other cuffs. Additionally, the present invention can advantageously apply pressure to an extremity almost instantaneously from the time the activation signal is sent due to its hydraulic rather than pneumatic operation. The applied pressure can also be varied with a high degree of precision with the present invention. Instead of simultaneous deflation of all cuffs at systole, the present invention, which does not require deflation, can vary the degrees of pressure on each cuff during systole. Because the apparatus of this invention does not rely on inflation or deflation of the cuffs, it can more gradually reduce the pressure applied by each individual cuff.

In an example embodiment of the invention, cuff 16 of actuator unit 10 is 6 inches wide, 24 inches long and 1 inch thick. Preferably, the width of cuff 16 is within the range of 1 to 20 inches. In one embodiment, cuff 58 of treatment apparatus 10 is 6 inches wide, 24 inches long, and 3 inches thick. Preferably, the width of cuff 58 is within the range of 3 to 15 inches.

In one embodiment, curved plate 36 of actuator unit 10 is 10 inches in diameter, 10 inches long, and ¼ inch thick. In one embodiment, curved plate 36 of actuator unit 10 for use on the hips is 12 inches in diameter, 10 inches long, and ¼ inch thick.

In one embodiment, hydraulic cylinder 18 is manufactured by SMC Corporation of America, as part number CHD-KDB25-50-F9BV. Pressure sensor 42 is an air pressure sensor, as manufactured by Freescale Co., as part number MPX4250A.

Compression of the cuffs may be correlated with physiological data including, but not limited to EKG, plethysmograph, cardiac output, heart rate, blood pressure, heart stroke volume, blood oxygen levels, systole and diastole. A variety of devices in the medical industry are used to detect and electrically transmit this physiological data from a patient. After such data is collected, it is typically processed within pulsation parameters to determine the proper sequence of cuff activation. Such data is typically received and processed by computer with cardiac pulsation treatment software. Typically, a computer processes the patient's electronic physiological data as well as electronic feedback data obtained from pressure sensors 42 installed in the cuffs. Treatment parameters can be changed based on either input from the clinician or from the processor program.

Figure 8:
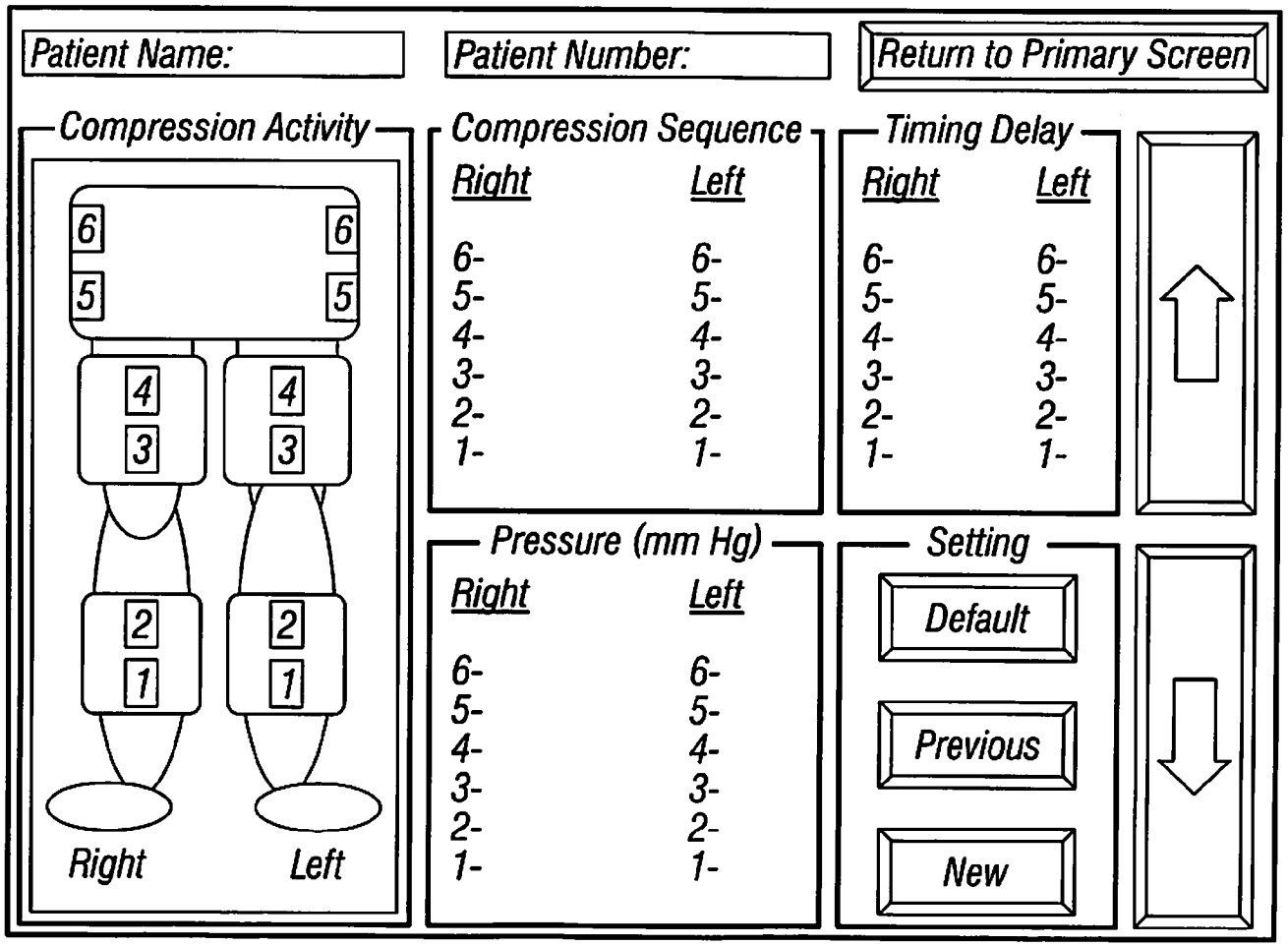
FIG. 8 is the display of a computer monitor screen of the pulsation treatment system of this invention.

In one embodiment of the invention, the computer or processor interfaces with an interactive touch screen video monitor, as illustrated in FIG. 8. During a counterpulsation treatment session, the monitor displays the patient's physiological indicators, such as systole, diastole, blood pressure, oxygen saturation of the blood, ECG, stroke volume, diastolic to systolic ratios, cardiac output, and heart rate. Through the monitor, the attending physician, nurse or technician monitors and controls the compression pressure, sequence, frequency of activation, and timing delay for each of the actuators, and may deactivate any of the actuators from the treatment program. The monitor also tracks activation status for each of the cuffs, showing for each cuff, data including but not limited to compressions, sequence with other cuffs, and strength of each compression. The attending physician, nurse or technician is thus able to maintain optimal benefit of the counterpulsation treatment. This is important as it is known that any patient's responsiveness or tolerance to treatment can change in a relatively short period of time during treatment. The user may also obtain printouts of monitored data through the interactive monitor.

The pulsation and counterpulsation apparatuses of the present invention, and many of their intended advantages, will be understood from the foregoing description of example embodiments, and it will be apparent that, although the invention and its advantages have been described in detail, various changes, substitutions, and alterations may be made in the manner, procedure, and details thereof without departing from the spirit and scope of the invention, as defined by the appended claims, or sacrificing any of its material advantages, the forms hereinbefore described being merely exemplary embodiments thereof.

I claim:

1. An apparatus for use in counterpulsation treatment of a patient wherein pressure is applied to the patient's blood vessels to stimulate blood flow, comprising:

at least one cuff to be received on a patient's body member, each said cuff having first and second ends;

said at least one cuff having a pressure relief valve;

at least one hydraulic actuator unit associated with said at least one cuff and controllably operable to a plurality of positions within a range of positions, said range of positions ranging from an original position to a maximum constricted position;

the at least one cuff applying maximum pressure to the patient's blood vessels to constrict the blood vessels in the maximum constricted position of the plurality of positions of the actuator;

the at least one cuff applying no pressure to the patient's blood vessels in the original position of the plurality of positions of the actuator; and said at least one hydraulic actuator unit controllably operable from said original position to any position within said range of positions on activation;

each hydraulic actuator unit including:

at least one hydraulic cylinder;

a shaft for each hydraulic cylinder respectively connected to and driven by the hydraulic cylinder, said shaft adjustable to a plurality of positions within said range of positions, wherein at least one said first or second end of the at least one cuff is operationally connected to said shaft; and a curved plate attached to the at least one hydraulic actuator unit intermediate said unit and said body member, wherein the plate is shaped and sized such that at least a portion of said body member is supported against the plate.

2. The apparatus of claim 1, wherein said at least one hydraulic actuator unit further includes a frame, and wherein said at least one hydraulic cylinder is pivotally mounted on said frame.

3. The apparatus of claim 1, wherein:

said shaft has upper and lower ends;

said lower end of said shaft is connected to the hydraulic cylinder; and said first end of the at least one cuff is associated with the upper end of said shaft.

4. The apparatus of claim 3, further comprising:

a roller rotatably associated with said upper end of said shaft through a linkage;

said linkage comprising a pin connected to said upper end of said shaft;

at least one extension connected to said pin;

said roller connected to said at least one extension; and, said first end of said at least one cuff connected to said roller.

5. The apparatus of claim 1, wherein:

said plate is generally quarter-cylinder shaped; and, said second end of said at least one cuff is removably attachable to said plate.

6. The apparatus of claim 5, wherein:

said second end of said at least one cuff is removably attachable to said plate by a hook and loop fastener system;

said hook and loop fastener system having a first fastener component and a second fastener component;

said first fastener component attached to said second end of said at least one cuff; and said second fastener component attached to said plate.

7. The apparatus of claim 1, wherein said at least one hydraulic cylinder is operable at variable frequencies, at least one said frequency being responsive to at least one type of data from a physiological measuring device.

8. The apparatus of claim 1, wherein said apparatus comprises first and second hydraulic actuator units, said hydraulic actuator units being disposed on opposite sides of said patient.

9. The apparatus of claim 8, wherein:

each said hydraulic actuator unit further includes a frame; and said hydraulic cylinders pivotally mounted on respective frames.

10. The apparatus of claim 9, wherein:

said shafts each have upper and lower ends;

said lower end of each said shaft connected to respective hydraulic cylinders;

said first end of said at least one cuff associated with said upper end of said shaft of one of first said first hydraulic actuator unit; and said second end of said at least one cuff associated with said upper end of said shaft of said second hydraulic actuator unit.

11. The apparatus of claim 10, further comprising:

a roller rotatably associated with said upper end of each said shaft through a linkage comprising a pin connected to said upper end of said respective shaft;

at least one extension connected to each said pin;

each said roller being connected to said respective extension;

said ends of said at least one cuff being connected to said rollers.

12. The apparatus of claim 8, wherein said plates are generally quarter-cylinder shaped.

13. The apparatus of claim 8, further comprising a thickened portion connected to said at least one cuff, wherein said thickened portion contains a pressure sensor installed thereon.

14. The apparatus of claim 8, wherein said hydraulic actuator units are affixed to one another by a connecting member and at least one said hydraulic actuator unit is slidably mounted on a treatment table.

15. The apparatus of claim 1, wherein each said at least one hydraulic cylinder has two fluid connection terminals.

16. A method of treating a medical condition using counterpulsation, the method comprising the steps of:

providing the apparatus of claim 1, wherein said at least one hydraulic cylinder is controllably operable from said original position to any position within said range of positions on activation;

positioning said at least one cuff on a predetermined area of a patient's body, wherein said at least one cuff contains a pressure sensor for communicating with an external processor;

applying sensors to said patient to detect predetermined physiological data;

detecting said physiological data from said patient through use of said sensors;

electronically processing said physiological data;

activating said at least one hydraulic cylinder and electronically timing said activation thereof to correlate with phases of said patient's heart whereby said activation produces a wave of blood through arteries and toward the area that is to be treated;

repeating the foregoing process as needed.

17. The method of claim 16 further comprising:

modifying said timing of said activation of said at least one hydraulic cylinder according to changes in said physiological data affected by said activation.

18. The method of claim 16 wherein:

said electronically processing step further includes processing said physiological data to determine when said patient's heart is in a diastolic or a systolic phase; and said activating step includes activating said at least one hydraulic cylinder to produce a retrograde wave of blood up the arteries to arrive at the heart when the heart is in the diastolic phase.

19. The method of claim 16 wherein said activating step includes activating said at least one hydraulic cylinder whereby pressure is applied in a determined sequence to said at least one cuff to produce a desired effect.

20. The method of claim 16 wherein said activating step includes activating said at least one hydraulic cylinder wherein graded pressure is applied in a determined manner to said at least one cuff to produce a desired effect.

21. The method of claim 16 wherein:

said activating step includes activating said at least one hydraulic cylinder to produce a wave of blood down the arteries and to a selected extremity of said patient to increase blood circulation therein.

22. An apparatus for use in counterpulsation treatment of a patient wherein pressure is applied to the patient's blood vessels to stimulate blood flow, comprising:

a plurality of cuffs sized and shaped to be received on predetermined areas of a patient's body, said cuffs having first and second ends;

at least one hydraulic actuator unit associated with one of said plurality of cuffs and controllably operable to a plurality of positions within a range of positions, said range of positions ranging from an original position to a maximum constricted position;

wherein at least one of said plurality of cuffs has a thickened cuff portion wherein said thickened cuff portion is inflatable;

each said hydraulic actuator unit including: at least one hydraulic cylinder; a shaft for each hydraulic cylinder respectively connected to and driven by the hydraulic cylinder; said shaft adjustable to a plurality of positions within said range of positions, said range of positions of said shaft corresponding to said range of positions of said hydraulic actuator unit.

23. The apparatus of claim 22, wherein said thickened cuff portion has at least one pressure sensor installed thereon.

24. The apparatus of claim 22, wherein said thickened cuff portion has at least one pressure relief valve installed thereon.

* * * * *